US006469427B1

(12) United States Patent
Itaya et al.

(10) Patent No.: US 6,469,427 B1
(45) Date of Patent: Oct. 22, 2002

(54) LAMP HAVING IMPROVED ELECTRICAL CONNECTION

(75) Inventors: Kenji Itaya, Takatsuki; Takeshi Matsumura, Kashiwara; Shiro Iida, Takatsuki, all of (JP)

(73) Assignee: Matsushita Electronics Corporation (JP)

( * ) Notice: Subject to any disclaimer, the term of this patent is extended or adjusted under 35 U.S.C. 154(b) by 50 days.

(21) Appl. No.: 09/588,298

(22) Filed: Jun. 7, 2000

(30) Foreign Application Priority Data

Jun. 15, 1999 (JP) ..... 11-167917

(51) Int. Cl.[7] ..... H01J 5/48
(52) U.S. Cl. ..... 313/318.04; 313/25; 439/615
(58) Field of Search ..... 313/318.09, 318.01, 313/318.04, 318.03, 573, 318.12, 25, 634; 439/615, 611

(56) References Cited

U.S. PATENT DOCUMENTS 6,323,588 B1 * 11/2001 Lilljedahl et al. ..... 313/318.1

FOREIGN PATENT DOCUMENTS

JP 04167327 * 6/1992 ..... H01J/5/50
JP 10-106488 4/1998

* cited by examiner

*Primary Examiner*—Vip Patel
*Assistant Examiner*—Joseph Williams
(74) *Attorney, Agent, or Firm*—Parkhurst & Wendel, LLP

(57) ABSTRACT

The present invention provides an inexpensive low-pressure mercury vapor discharge lamp having enhanced productivity. The low-pressure mercury vapor discharge lamp comprises an arc tube, a holder for holding the arc tube, a lighting circuit held on the opposite side of the holder from the arc tube and adapted for lighting the arc tube, a case having a screw portion provided at one end thereof and adapted for accommodating the lighting circuit, and a base threaded and fixed to the screw portion. A recessed groove is provided in a helical screw thread of the screw portion. The two lead wires (top lead wire and side lead wire) which are power source wires are respectively connected at one end thereof to the lighting circuit. The side lead wire is disposed along the groove and is sandwiched and fixed between the base and the screw portion.

6 Claims, 3 Drawing Sheets

LAMP HAVING IMPROVED ELECTRICAL CONNECTION

FIELD OF THE INVENTION

The present invention relates to a low-pressure mercury vapor discharge lamp.

BACKGROUND OF THE INVENTION

As a conventional low-pressure mercury vapor discharge lamp, e.g., a fluorescent lamp device, there is a lamp as described in Japanese Patent Application Laid-open No. 10-106488.

This conventional lamp includes an outer cover integrally comprising a cover portion to which a fluorescent lamp and a lighting part are mounted, and a screw receiving portion projecting from the cover portion and having a screw thread formed on an outer peripheral face of the screw receiving portion.

The screw-receiving portion is provided with a lead wire insertion part along the axial direction of the screw-receiving portion.

One of two lead wires led out from the lighting part is inserted into the lead wire insertion part, and is sandwiched between the cover portion and a base threadedly engaged with the screw receiving portion. In this state, the one lead wire is led out from the outer case and connected to a body terminal of the base by soldering.

In such a conventional lamp, the lead wire can be strongly fixed by connecting the lead wire to the base by soldering.

However, since the soldering is used, there arises a problem with the conventional lamp that the cost is increased.

Further, since the solder is necessary, there is a problem that the manufacturing process becomes complicated and the productivity is lowered.

The present invention has been accomplished to solve these problems, and it is an object of the invention to provide an inexpensive low-pressure mercury vapor discharge lamp having enhanced productivity.

SUMMARY OF THE INVENTION

In a low-pressure mercury vapor discharge lamp, a case accommodating a lighting circuit has a screw portion formed at one end thereof, a base is threaded and fixed into the screw portion, a lead wire connected to the lighting circuit is disposed along a groove formed in the screw portion and is sandwiched and fixed between the screw portion and the base.

A low-pressure mercury vapor discharge lamp according to the present invention comprises a case accommodating a lighting circuit and formed at one end thereof with a screw portion, a base threaded and fixed into said screw portion, a lead wire connected to said lighting circuit, and a groove provided in said screw portion, the lead wire being disposed along said groove and sandwiched and fixed between said screw portion and said base.

With the above arrangement, the lead wire that is sandwiched between the screw portion and the base is long, so that the lead wire can strongly be fixed without using soldering and the number of composing members or the manufacturing steps can be reduced. As a result, the costs can be reduced and the productivity enhanced.

DESCRIPTION OF THE PREFERRED EMBODIMENT

An embodiment of the present invention will be explained with reference to the drawings below.

Figure 1:
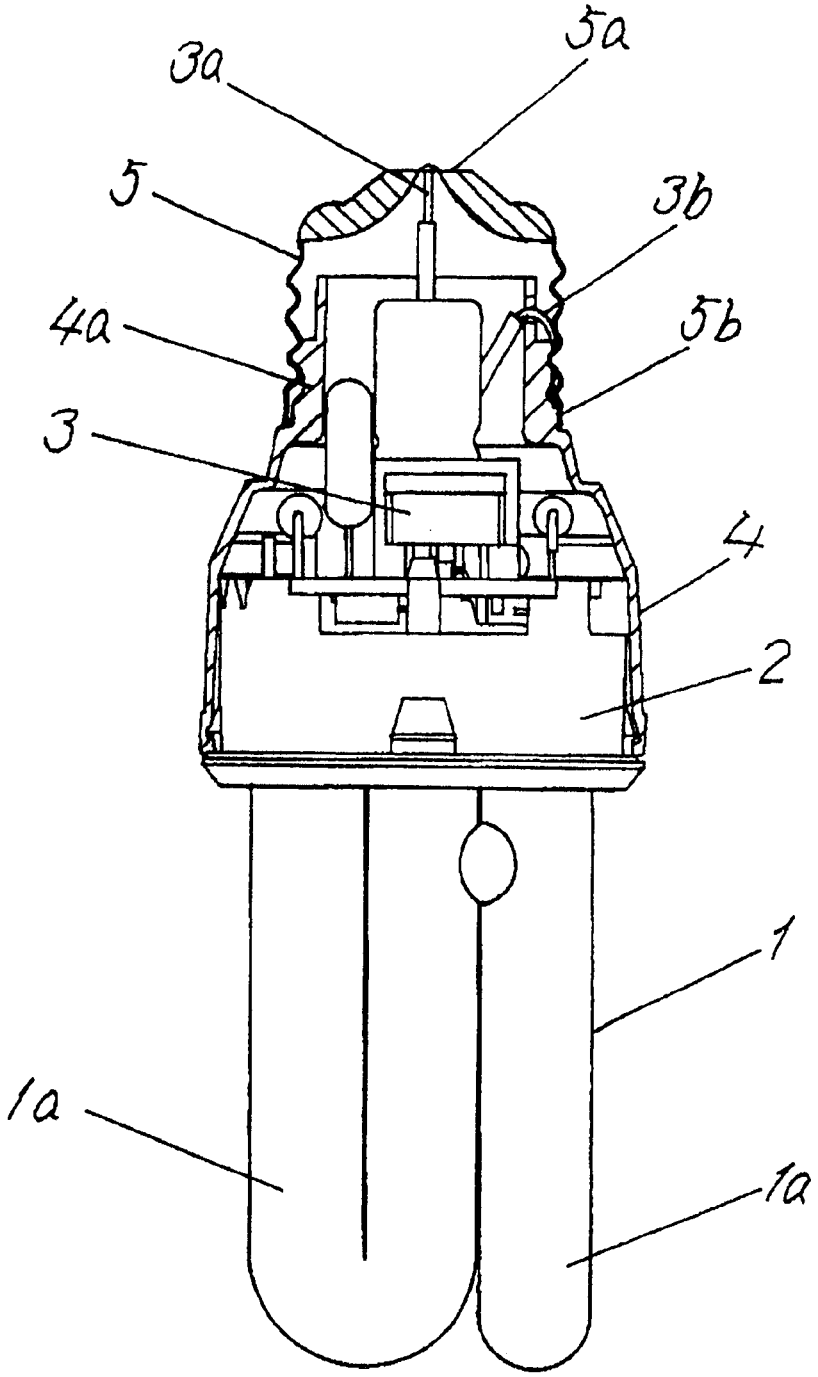
FIG. 1 is a partially cut-away front view of a low-pressure mercury vapor discharge lamp having a power rating of 13 W in accordance with an embodiment of the present invention.

As shown in FIG. 1, a low-pressure mercury vapor discharge lamp having a power rating of 13 W in accordance with an embodiment of the present invention comprises an arc tube 1 having an outer diameter of 11 mm and formed by bridge-jointing a few U-shaped tubes 1*a*, a holder 2 for holding the arc tube 1, a lighting circuit 3 held on the opposite side from the arc tube 1 of the holder 2 for lighting the arc tube 1, a case 4 provided at its one end with a screw portion 4*a* and accommodating the lighting circuit 3, and a screw base 5 such as E26-type Edison base which is threaded to the screw portion 4*a* and then crimped and fixed.

The arc tube 1 is provided at its opposite ends with filament coils (not shown). An illuminant is applied to an inner face of the arc tube 1. Predetermined amounts of rare gas and mercury are charged into the arc tube 1.

Figure 2:
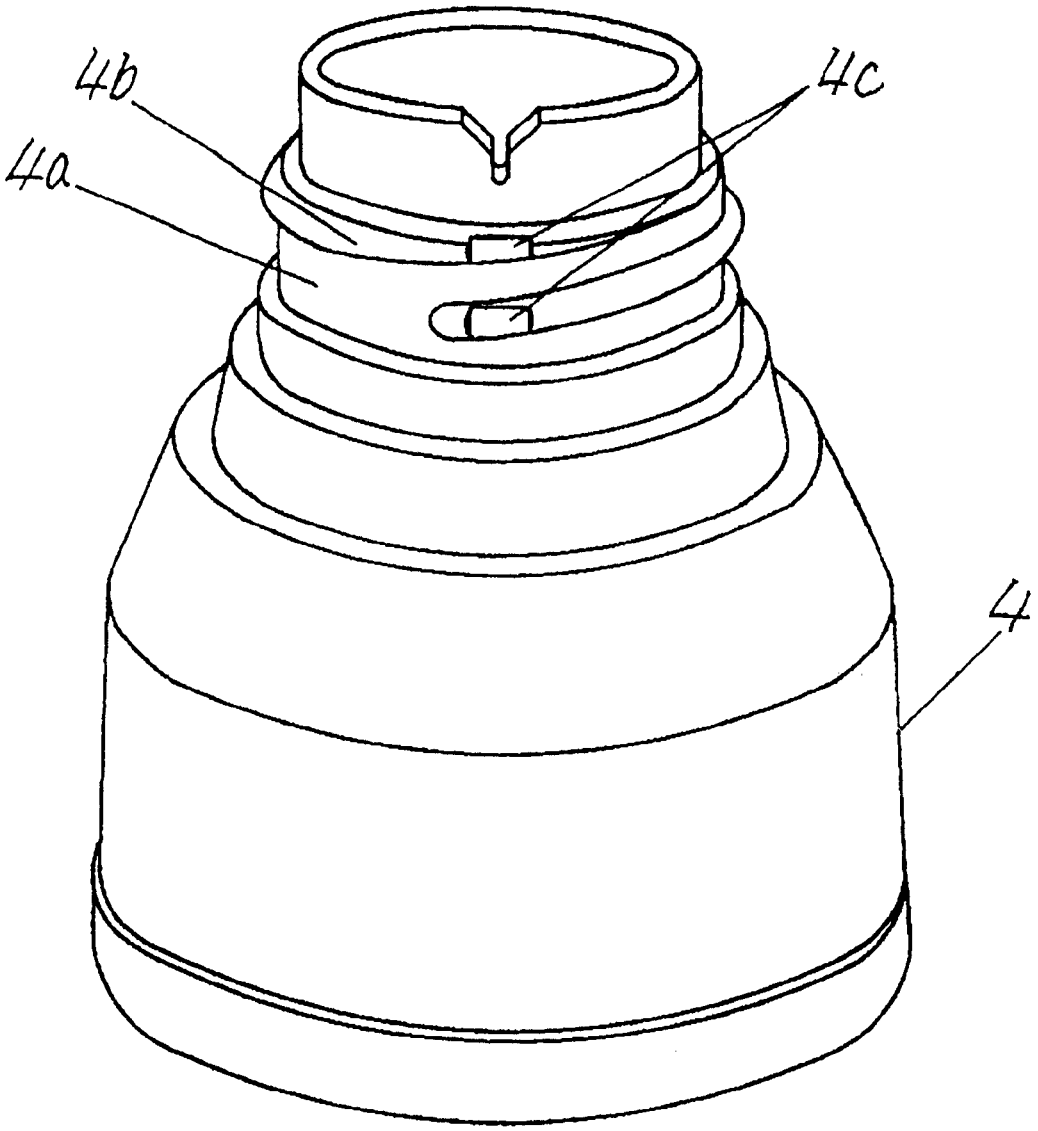
FIG. 2 is a perspective view of a case used for the low-pressure mercury vapor discharge lamp.

As shown in FIG. 2, a screw thread 4*b* of the screw portion 4*a* is provided with two recess grooves 4*c*.

The height of the screw thread 4*b* is 1 mm.

Each of the recess grooves 4*c* has a width of 3 mm and a depth of 0.6 mm, and its bottom face is flat.

Figure 3:
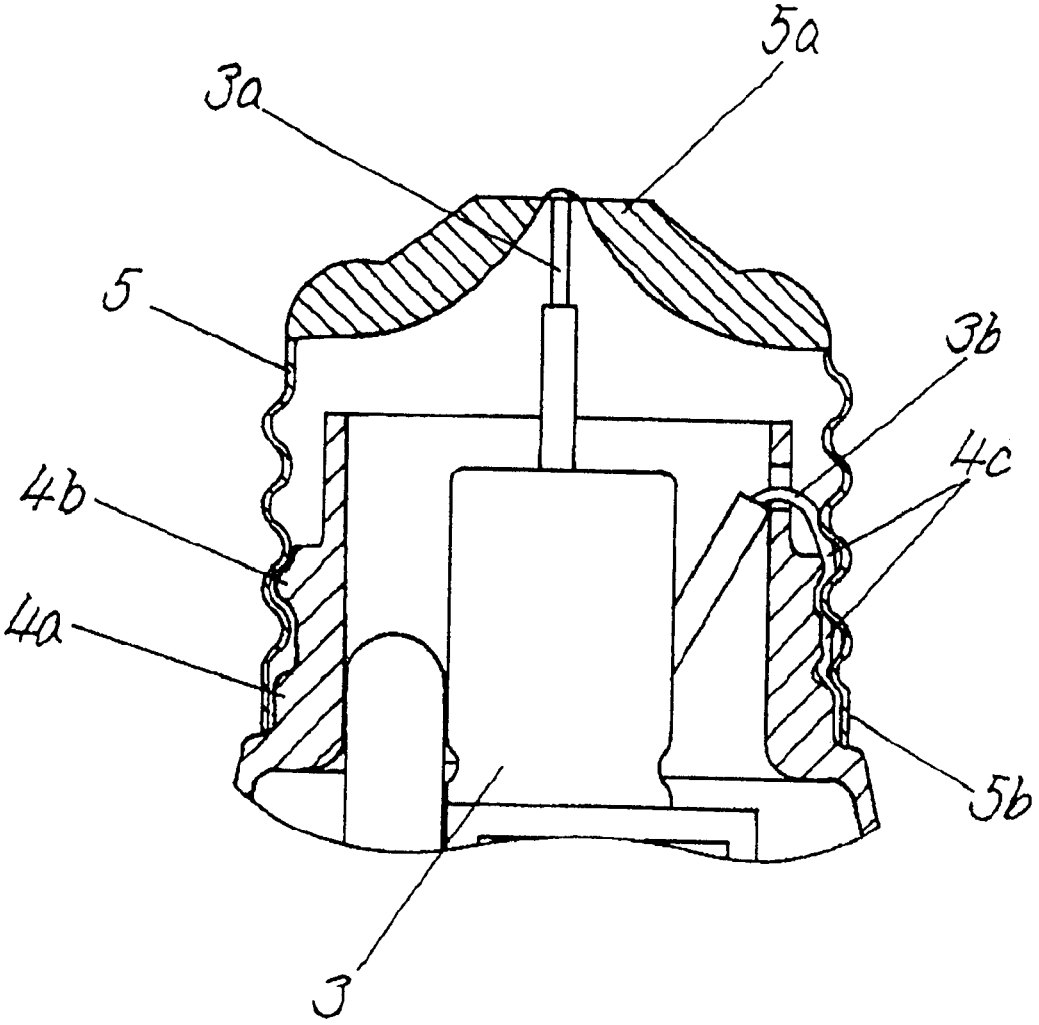
FIG. 3 is an enlarged sectional view of an essential portion of the low-pressure mercury vapor discharge lamp.

As shown in FIG. 3, the two lead wires (hereinafter, one is called "top lead wire 3*a*" and the other is called "side lead wire 3*b*") which are power source wires are respectively connected at one end thereof to the lighting circuit 3.

Diameter of each lead wires 3*a*, 3*b* is 0.5 mm.

The other end of the top lead wire 3*a* is electrically connected to an eyelet terminal 5*a* of the base 5 by soldering or welding.

The side lead wire 3*b* is disposed along the groove 4*c*, and is sandwiched and fixed between the screw portion 4*a* and a body terminal 5*b*, and is electrically connected to the body terminal 5*b*.

According to the above-described structure of the present invention, the side lead wire 3*b* sandwiched between the screw portion 4*a* and the base 5 is long. Therefore, the side lead wire 3*b* can strongly be fixed without using a member such as soldering. As a result, the number of composing members or manufacturing processes can be reduced, the costs can be reduced, and the productivity can be enhanced.

Further, since the base 5 is threaded to the screw portion 4*a*, a lateral bending strength and a torque strength are increased, and the base 5 can be less prone to come off from the screw thread 4*b*. That is, a fixing strength of the case 4 to the base 5 can be enhanced.

Further, the side lead wire 3*b* is disposed in the groove 4*c*, so that the side lead wire 3*b* can be prevented from coming off from the groove 4*c* when the base 5 is threaded into the screw thread 4*b*. Thus, it is possible to prevent the electrical connection between the side lead wire 3*b* and the base 5 from becoming imperfect.

Here, it is preferable that the side lead wire 3*b* is in a meandering shape along an inner face of the base 5.

With this design, a contact area between the side lead wire 3*b* and the base 5 is increased, and the side lead wire 3*b* and the base 5 can be reliably connected electrically to each other. Therefore, it is possible to obtain a low-pressure mercury vapor discharge lamp having excellent reliability, and to fix the side lead wire 3*b* more strongly.

It is preferable that the maximum depth of the groove 4*c* is equal to or greater than ¼ of the diameter of the side lead wire 3*b,* and equal to or less than the height of the screw thread 4*b.*

With this design, when the base 5 is threaded into the screw portion 4*a,* it is possible to prevent the side lead wire 3*b* from coming off from the groove 4*c,* and to electrically connect the side lead wire 3*b* and the base 5 more reliably.

It is preferable that the width of the groove 4*c* is equal to or greater than 1.5 times and equal to or less than 8 times of the diameter of the side lead wire 3*b.*

With this design, the side lead wire 3*b* can easily be disposed in the groove 4*c,* and the side lead wire 3*b* can be fixed to a predetermined position.

Although the arc tube 1 is formed by bridge-jointing a few U-shaped tubes la in the above embodiment, the same effect can be obtained even if a double U-shaped arc tube is used.

As explained above, according to the present invention, it is possible to provide a low-pressure mercury vapor discharge lamp in which the cost can be reduced, the productivity is enhanced, the fixing strength of the base to the case can be enhanced, and further the electrical connection between the side lead wire and the base can be prevented from becoming imperfect.

What is claimed is:

1. A lamp comprising:

a case accommodating a lighting circuit and formed at one end thereof with a screw portion, a base threaded and fixed into said screw portion, a lead wire connected to said lighting circuit, and a groove having a bottom surface provided in an outer face of said screw portion in a direction perpendicular to the circumference of said screw portion, the lead wire having a portion located along said groove and sandwiched and fixed between said screw portion of said case and the threaded portion of said base, said sandwiched and fixed portion of said lead wire being arranged in a meandering shape along an inner face of said base.

2. A lamp according to claim 1, wherein the groove is located in a helical screw thread of said screw portion.

3. A lamp according to claim 1, wherein the maximum depth of said groove is at least ¼ the diameter of said lead wire and at most the height of said screw thread.

4. A lamp according to claim 1, wherein the maximum width of said groove is at least 1.5 times and at most 8 times the diameter of said lead wire.

5. A lamp comprising:

a base threaded and fixed into a screw portion of a side of an arc tube, a lead wire that is a power source for said arc tube, and a groove having a bottom surface provided in an outer face of said screw portion in a direction perpendicular to the circumference of said screw portion, the lead wire being disposed along said groove and sandwiched and fixed between said screw portion on the side of said arc tube and the threaded portion of said base, said sandwiched and fixed portion of said lead wire being arranged in a meandering shape along an inner face of said base.

6. The lamp according to claim 5, wherein said are tube is a low-pressure mercury vapor discharge arc tube.

* * * * *